US007297389B2

(12) United States Patent
Lobry

(10) Patent No.: US 7,297,389 B2
(45) Date of Patent: Nov. 20, 2007

(54) TOP PLATE FOR A UNITARY SUSPENSION DEVICE OF A MULTI-ELEMENT BED BASE

(76) Inventor: Jacques Lobry, 30 rue de Gionne, 18000 Bourges (FR)

( * ) Notice: Subject to any disclaimer, the term of this patent is extended or adjusted under 35 U.S.C. 154(b) by 0 days.

(21) Appl. No.: 10/852,947

(22) Filed: May 24, 2004

(65) Prior Publication Data

US 2004/0253415 A1 Dec. 16, 2004

(30) Foreign Application Priority Data

May 23, 2003 (FR) ..... 03 06236

(51) Int. Cl.
*B32B 1/00* (2006.01)
*A47C 7/02* (2006.01)
*A47C 23/02* (2006.01)

(52) U.S. Cl. ..... 428/174; 428/95; 428/131; 428/137; 428/169; 297/452.63; 267/106; 267/143; 267/146; 5/247; 5/255

(58) Field of Classification Search ..... 428/81, 428/95, 121, 131, 137, 156, 174, 192; 267/81, 267/106, 142, 143, 160, 146, 151; 297/142, 297/143, 452.56, 452.63; 5/247, 255, 719
See application file for complete search history.

(56) References Cited

U.S. PATENT DOCUMENTS 6,477,727 B1 11/2002 Fromme

FOREIGN PATENT DOCUMENTS

| | | |
|---|---|---|
| DE | 196 37 933 | 1/1998 |
| DE | 297 12 720 | 9/1998 |
| FR | 2 790 929 | 9/2000 |
| FR | 2 831 036 | 4/2003 |

*Primary Examiner*—Donald J. Loney
(74) *Attorney, Agent, or Firm*—James Ray & Assoc.

(57) ABSTRACT

The invention provides a top plate for a unitary suspension device for a multi-element type bed base made with a plurality of unitary suspension devices disposed in rows and columns on a support platform, the top plate being quadrangular in shape and including in its central region fastener members for fastening to the top end of a suspension structure of a unitary device, wherein the corners of the top face of the plate are raised and define a horizontal plane situated above the face, and wherein the top plate presents around its central region a first convex surface forming a dome. Advantageously, the top face of the top plate presents in the vicinity of each of its corners a second convex surface tangential to the horizontal plane and connected to the dome via demarcation lines.

12 Claims, 6 Drawing Sheets

TOP PLATE FOR A UNITARY SUSPENSION DEVICE OF A MULTI-ELEMENT BED BASE

The invention relates to the bedding plane of a multi-element type bed base.

More precisely, the invention relates to a top plate for a unitary suspension device for a multi-element type bed base made by means of a plurality of unitary suspension devices disposed in rows and columns on a support platform, said top plate being quadrangular in shape and including, in its central region, fastener means for fastening to the top end of a suspension structure of a unitary device.

BACKGROUND OF THE INVENTION

Such a unitary suspension device is described in the patent application published under the No. FR 2 824 246 in the name of the Applicant. That device comprises a base element fixed on an element of a platform, a suspension structure fixed on the base element, and a top plate carried by the suspension structure and fastened thereon by a quarter-turn fastener device.

The unitary suspension devices are disposed in rows and columns on the platform, and the generally rectangular top plates are disposed in a common plane so as to constitute a checkerboard or matrix configuration. These top plates are spaced apart from one another by gaps having a width lying in the range 1 centimeter (cm) to 4 cm.

In general, the top plates are plane. In FIGS. 2 and 8, FR 2 824 246 shows top plates having the shape of flat dinner plates and, in FIG. 28, it shows a top plate whose edges flare slightly downwards.

Those top plates are in contact with the mattress and they extend above the platform like studs that are separated from one another or like paving stones that are poorly jointed.

Those top plates give the impression of being insufficiently strong if they are made of plastic, and an impression of being too rigid if they are made of wood, whereas the bulking of the padding under the mattress gives an impression of comfort.

OBJECT AND SUMMARY OF THE INVENTION

The object of the invention is to propose mattress support plates for bed bases of the multi-element type that produce an impression of comfort, and that above all prevent the mattress from shifting.

According to the invention, this object is achieved by the fact that the plurality of top plates of a multi-element bed base made by juxtaposing unitary suspension devices including the top plates of the invention present on their top faces domes that fit in the indentations of the padding of the mattress that is to be supported.

More precisely, in the top plates of the invention, the corners of the top face of said plate are raised and define a horizontal plane situated above said face, and said top plate presents around its central region a first convex surface forming a dome.

In a first embodiment, the top face of said top plate presents in the vicinity of each of its corners a second convex surface tangential to said horizontal plane and connected to the dome via demarcation lines.

The adjacent corners of four top plates disposed in end-to-end and side-by-side pairs in the mattress support plane, thus form another dome. In addition, the demarcation lines extending substantially diagonally close to the corners form sinusoidal lines extending in the diagonal direction of the bed base, thereby considerably improving its appearance.

In a second embodiment, the top face of said plate presents sloping surfaces along two opposite edges, said sloping surfaces being connected to said dome via demarcation lines.

The top plate also includes ventilation openings in the vicinity of the demarcation lines.

In either embodiment, the top plate presents a plurality of stiffening ribs extending in a star configuration around the central region.

The top plate further comprises stiffening ribs beneath the demarcation lines.

In order to improve the appearance of the bed base, the top plate includes a peripheral rim extending beneath its bottom face.

Advantageously, the top plate may be made by injection molding a plastics material.

Preferably, it is covered in a fabric that is overmolded during molding.

BRIEF DESCRIPTION OF THE DRAWINGS

Other advantages and characteristics of the invention appear on reading the following description given by way of example and made with reference to the accompanying drawings, in which.

MORE DETAILED DESCRIPTION

Figure 1:
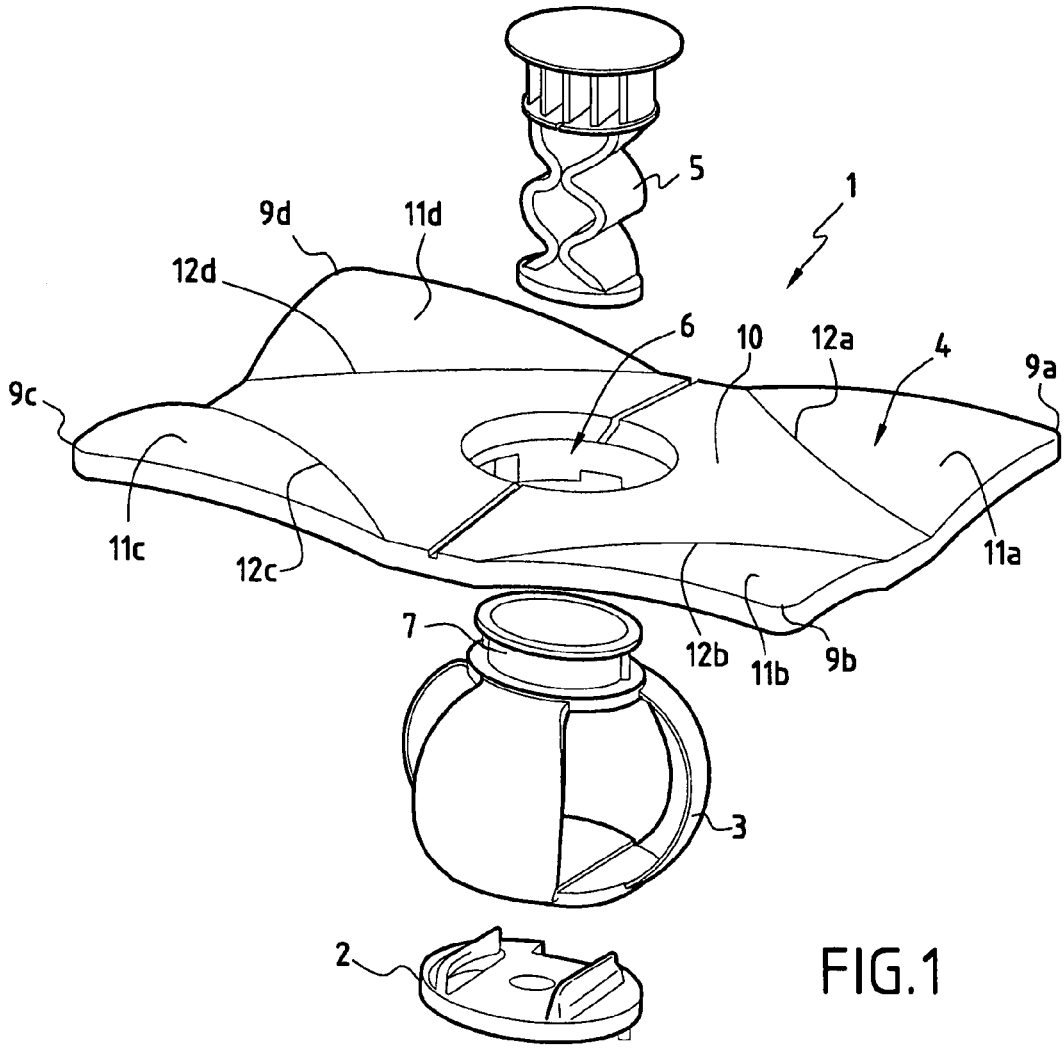
FIG. 1 is an exploded view of a unitary suspension device fitted with a top plate constituting a first embodiment of the invention.

FIG. 1 shows a unitary suspension device 1 of a multi-element bed base, the device being for fixing on a cross-member of a support platform not shown in the drawing. The device 1 essentially comprises three elements: a base element 2 for fixing on a cross-member; a suspension structure 3 mounted on the base element 2; and a top plate 4 supported by the suspension structure 3.

The top plate 4 serves as a support for a padding element, e.g. a mattress, not shown in the drawings. The suspension device may further comprise a stiffener member 5 enabling the stiffness of the suspension device 1 to be modified, depending on its position within the bed base.

The bed base comprises a plurality of suspension devices disposed in juxtaposed rows and columns.

A detailed description of the base element 2, the suspension structure 3, the stiffener member 5, and the members for fixing the top plate 4 on the top end of the suspension structure 3 is to be found in the patent application published under the No. FR 2 824 246, and no further explanation is required. It suffices to know that the top plate 4 presents in its center region an orifice 6 that receives the top end 7 of the suspension structure 3, these two elements presenting complementary fastener means 8 enabling the top plate 4 to be secured to the suspension structure 3 by sliding and turning through one-fourth of a turn. After assembly, the orifice 6 is closed by a plug (not shown in the drawings).

In the invention, the top plate 4 is in the form of a plate that is not plane and that is of uniform thickness, being of quadrangular section with its four corners 9*a*, 9*b*, 9*c*, and 9*d* being raised, and with its top face 4*a* presenting around the orifice 6 a first convex surface 10 forming a dome situated beneath the horizontal plane defined by the corners of the top plate 4*a*.

In a first embodiment of the invention shown in FIGS. 1 to 6, the top face 4*a* of the top plate 4 presents, in the regions of its four corners 9*a* to 9*d*, second convex surfaces 11*a* to 11*d* separated from one another and connected to the first convex surface 10 via curvilinear demarcation lines given respective references 12*a* to 12*d*.

Figure 2:
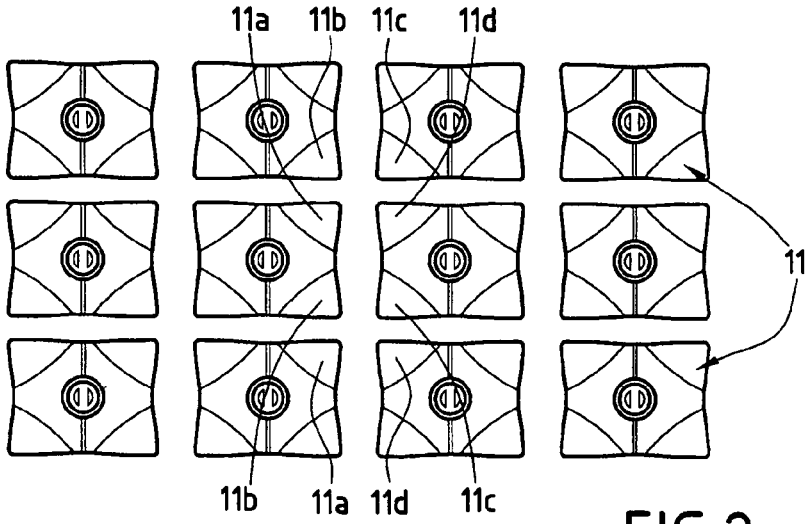
FIG. 2 is a plan view of a portion of a bed base made using unitary suspension devices as shown in FIG. 1.
Figure 3:
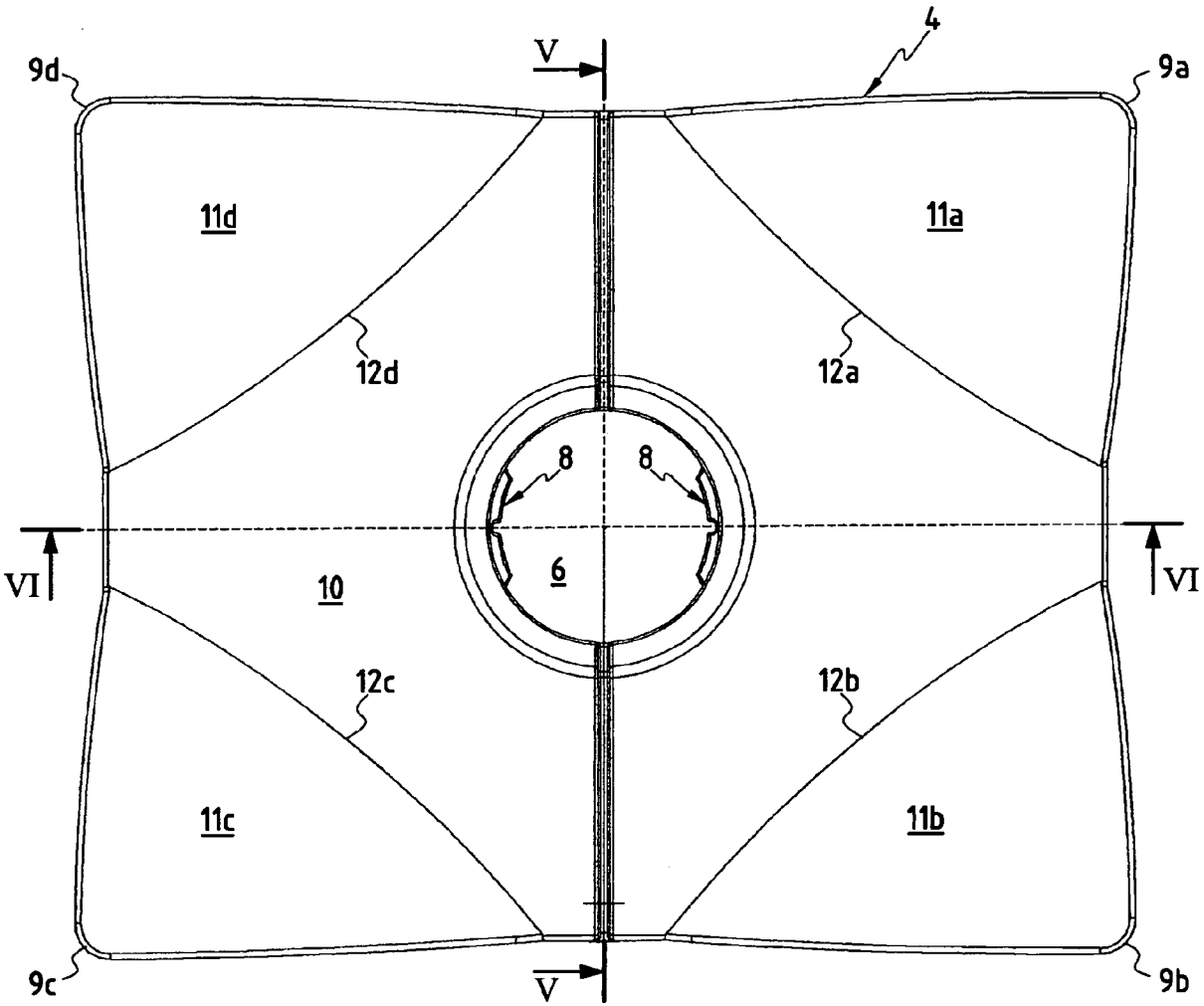
FIG. 3 is a view of the top of the FIG. 1 top plate.
Figure 5:
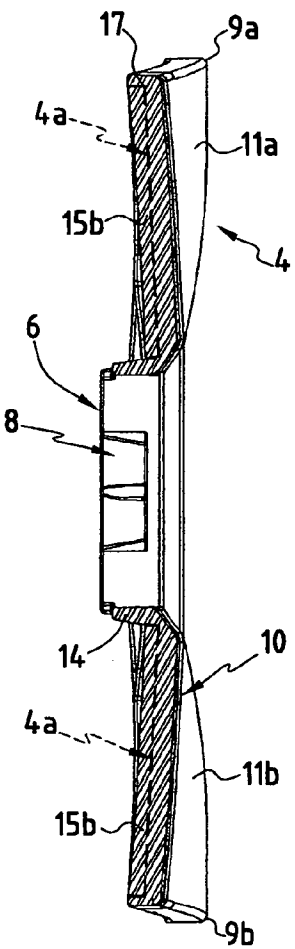
FIG. 5 is a section on line V-V of FIG. 3.

FIG. 2 shows the appearance of the top face of a multi-element bed base made using the unitary devices 1 as described above. The curvilinear demarcation lines 12*a* to 12*d* of a top plate 4 form geometrical figures similar to lozenges, and the set of demarcation lines of all of the top plates together form sinusoidal lines extending diagonally relative to the bed base.

The adjacent corners 9*a* to 9*d* of four adjacent plates juxtaposed in pairs end to end and side by side together form a dome of height that is slightly greater than the height of the dome 10.

Most advantageously, the horizontal plane defined by the four corners 9*a* to 9*d* of the top face 4*a* of a top plate 4 is substantially tangential to the convex surfaces 11*a* to 11*d* of that top plate. Preferentially, the convex surfaces 11*a* to 11*d* slop in order to raise progressively the mattress, so that, in particular, the four corners 9*a* to 9*d* do not damage the mattress.

This horizontal plane is disposed slightly higher than the dome 10.

Figure 4:
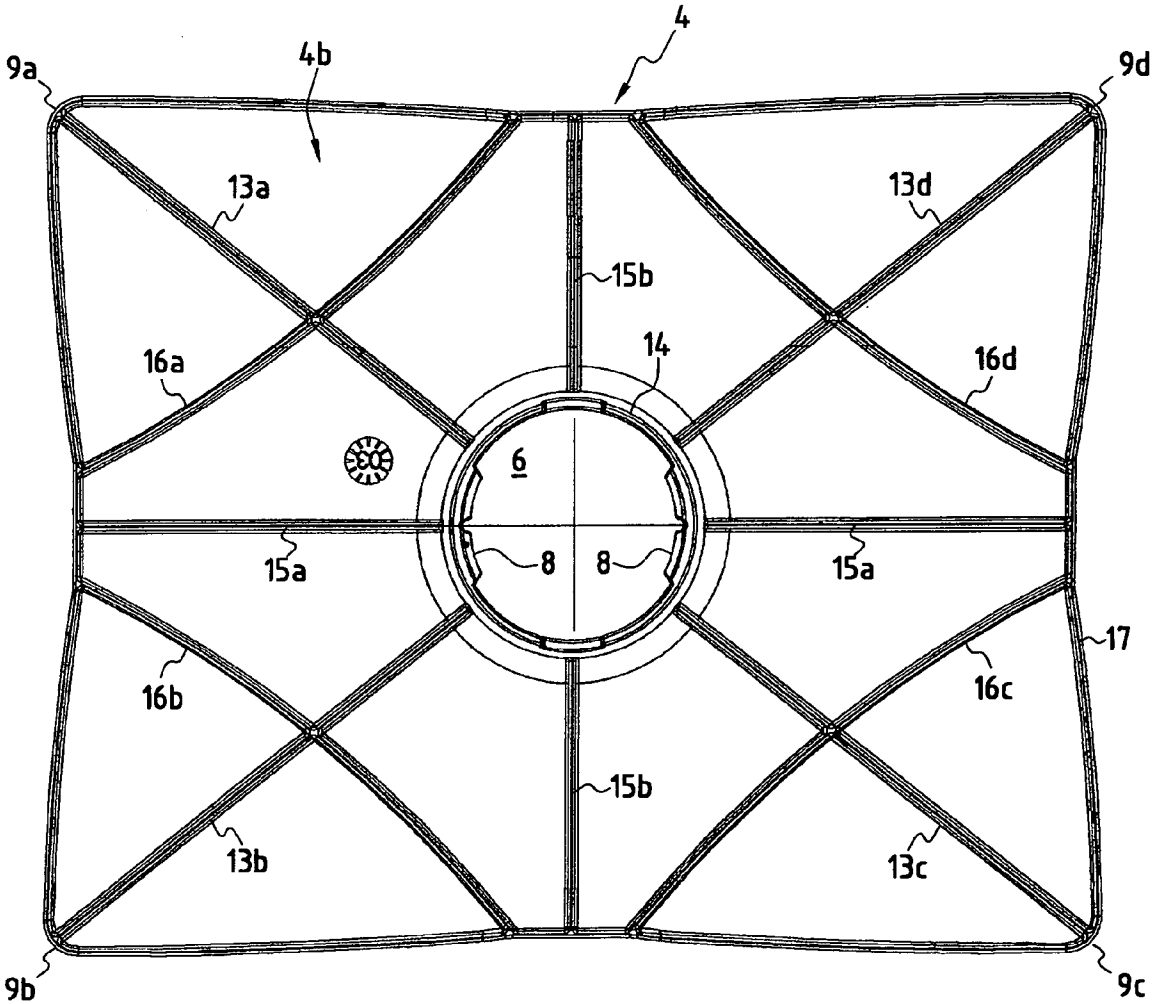
FIG. 4 is a view of the bottom of the FIG. 1 top plate.
Figure 6:
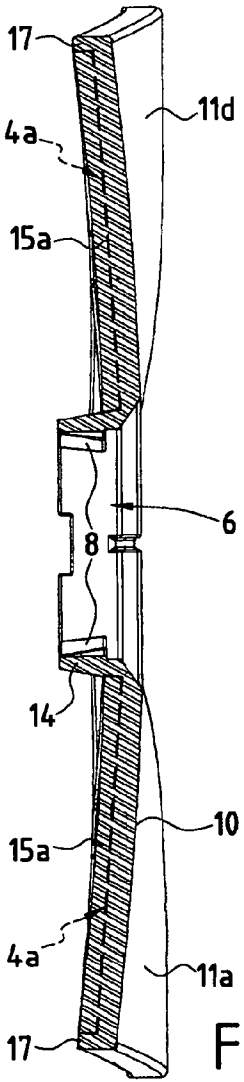
FIG. 6 is a section on line VI-VI of FIG. 3.
Figure 7:
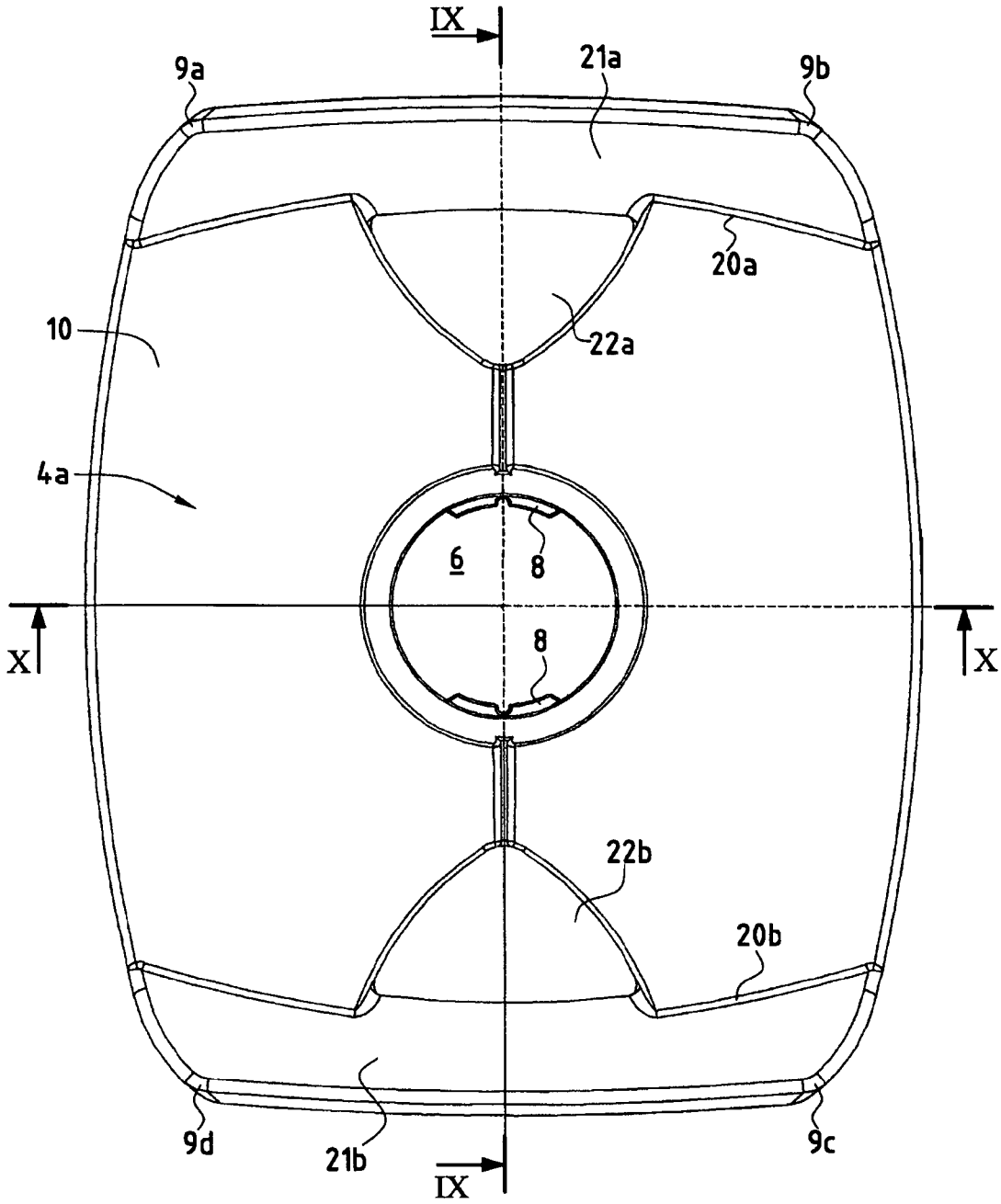
FIG. 7 is a view of the top of a top plate in a second embodiment of the invention.
Figure 8:
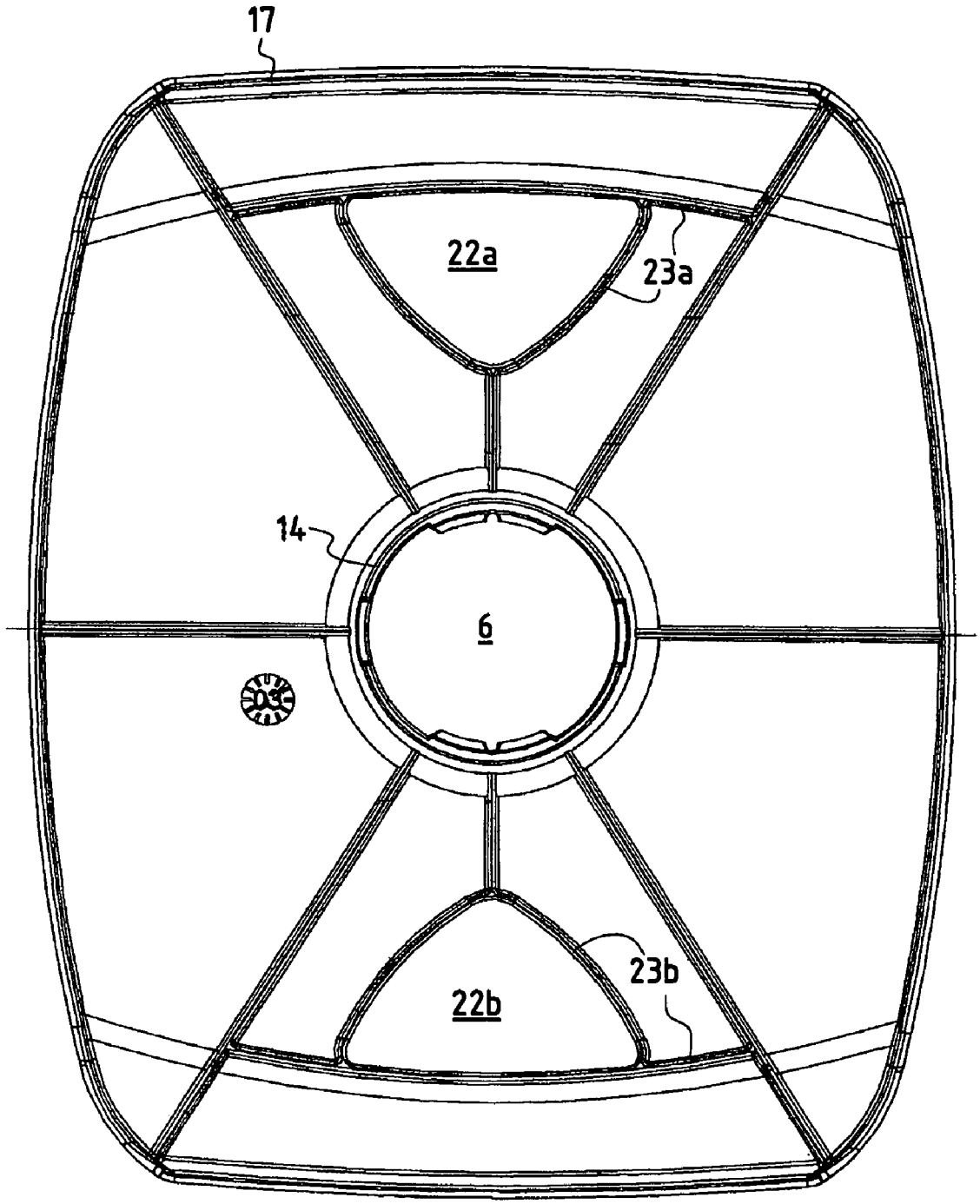
FIG. 8 is a view of the bottom of the FIG. 7 top plate.
Figure 9:
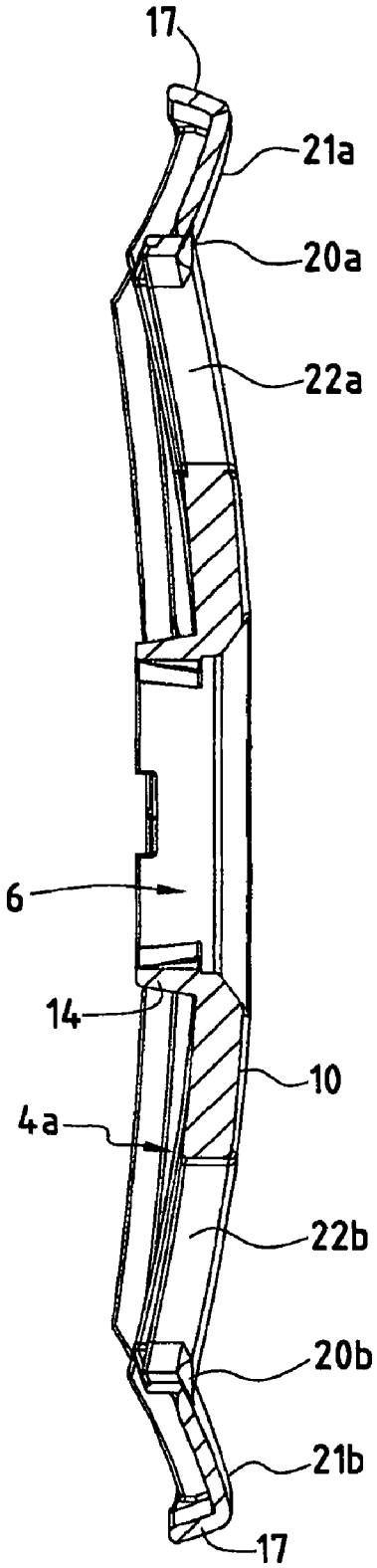
FIG. 9 is a section on line IX-IX of FIG. 7.
Figure 10:
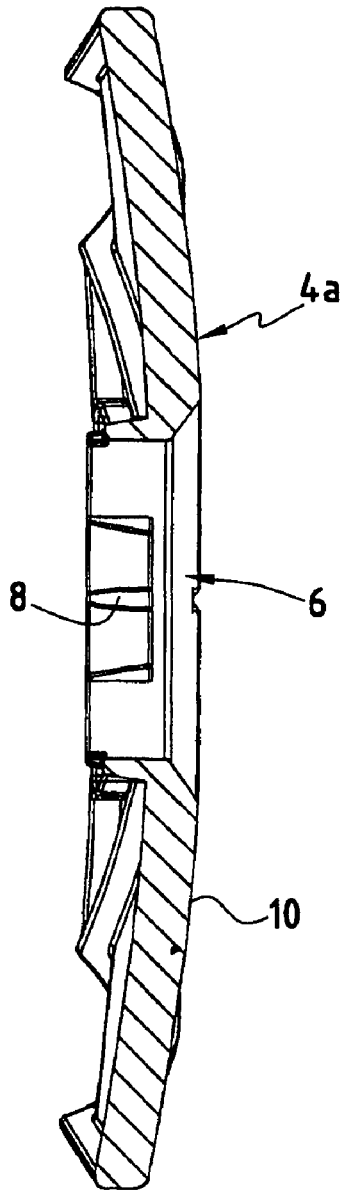
FIG. 10 is a section on line X-X of FIG. 7.

As shown in FIG. 4, the top plate 4 has a bottom face 4*b* presenting a plurality of stiffening ribs extending in a star configuration around the orifice 6, in particular ribs 13*a*, 13*b*, 13*c*, and 13*d* connecting the sleeve 14 which surrounds the orifice 6, which includes the fastening 8, and which extends beneath the bottom face, to the corners 9*a* to 9*d*, and also middle ribs 15*a* and 15*b* parallel to the sides of the top plate 4.

Additional stiffening ribs 16*a* to 16*d* are provided under the demarcation lines 12*a* to 12*d*.

In addition, the top plate 4 presents a peripheral rim 17 which extends under the bottom face 4*b* and to which the outer ends of the stiffening ribs are connected.

The top plate 4 may be made either of metal, or of wood, or of a plastics material. It is preferably made of a plastics material by an injection-molding method.

Most advantageously, the top face 4*a* of the top plate 4 and the peripheral rims are covered in furnishing fabric. When the top plate is made of plastics material, a piece of fabric is placed in the bottom of the mold prior to the injection-molding operation, thus becoming overmolded during injection of the plastics material.

FIGS. 7 to 10 show a second embodiment of the invention.

The top plate 4 in the second embodiment of the invention has four corners 9*a* to 9*d* which are raised above its top face 4*a*.

The orifice 6 and the fastener means 8 are identical to those of the first embodiment, and the top face 4*a* presents around the orifice 6 a first convex surface 10 that forms a dome. Along diametrically opposite demarcation lines 20*a* to 20*b*, the dome is connected to convex sloping surfaces 21*a*, 21*b* and disposed along two opposite side edges of the top plate 4. The corners 9*a* and 9*b* occupy the same convex sloping surface 21*a*, while the other two corners 9*c* and 9*d* occupy the other convex sloping surface.

The convex sloping surfaces 21*a*, 21*b* progressively raise the mattress so that it will not be damaged.

The top plate 4 also includes two ventilation openings 22*a* and 22*b* of triangular outline which open out in the dome 10 and which have outer sides adjacent to corresponding demarcation lines 20*a* or 20*b*.

The top plate in the second embodiment also presents on its bottom face 4*b* stiffening ribs which extend in a star configuration around the sleeve 14, a peripheral rim 17, and stiffening ribs 23*a* and 23*b* beneath the demarcation lines 20*a* and 20*b* and around the openings 22*a* and 22*b*.

Like the top plate 4 of the first embodiment, this top plate 4 can be made out of various materials, in particular by injection molding a plastics material in a mold with a piece of fabric being overmolded thereon.

What is claimed is:

1. A top plate for a unitary suspension device for a multi-element type bed base made by means of a plurality of unitary suspension devices disposed in rows and columns on a support platform, said top plate being quadrangular in shape and including in its central region fastener means for fastening to the top end of a suspension structure of a unitary device, wherein the corners of the top face of said plate are raised and define a horizontal plane situated above said face, wherein said top plate presents around its central region a first convex surface forming a dome, wherein the top face of said top plate presents in the vicinity of each of its corners a second convex surface tangential to said horizontal plane and connected to the dome via demarcation lines.

2. A top plate according to claim 1, wherein its bottom face presents a plurality of stiffening ribs extending in a star configuration around the central region.

3. A top plate according to claim 1, including a peripheral rim extending beneath its bottom face.

4. A top plate according to claim 1, the top plate being made by injection molding a plastics material.

5. A top plate according to claim 1, the top plate being covered in a fabric that is overmolded during molding.

6. A top plate for a unitary suspension device for a multi-element type bed base made by means of a plurality of unitary suspension devices disposed in rows and columns on a support platform, said top plate being quadrangular in shape and including in its central region fastener means for fastening to the top end of a suspension structure of a unitary device, wherein the corners of the top face of said plate are raised and define a horizontal plate situation above said face, wherein said top plate presents around its central region a first convex surface forming a dome, wherein the top face of said plate presents sloping surfaces along two opposite edges, said sloping surfaces being connected to said dome via demarcation lines.

7. A top plate according to claim 6, including ventilation openings in the vicinity of the demarcation lines.

8. A top plate according to claim 6, wherein its bottom face presents a plurality of stiffening ribs extending in a star configuration around the central region.

9. A top plate according to claim 8, further comprising stiffening ribs beneath the demarcation lines.

10. A top plate according to claim 6, including a peripheral rim extending beneath its bottom face.

11. A top plate according to claim 6, the top plate being made by injection molding a plastics material.

12. top plate according to claim 11, the top plate being covered in a fabric that is overmolded during molding.

* * * * *